United States Patent [19]

Abildgaard

[11] Patent Number: 4,685,700

[45] Date of Patent: Aug. 11, 1987

[54] BOOKBINDING STRIPS AND METHOD OF BINDING BOOKS

[75] Inventor: William H. Abildgaard, Redwood City, Calif.

[73] Assignee: Velo Bind, Inc., Sunnyvale, Calif.

[21] Appl. No.: 663,214

[22] Filed: Oct. 22, 1984

[51] Int. Cl.[4] ..... B42D 13/00; B42F 13/36; B42F 13/00; B21F 45/22

[52] U.S. Cl. ..... 281/21 R; 402/68; 402/80 P; 29/13

[58] Field of Search ..... 281/21 R; 402/13, 68, 402/80 P; 412/7, 43, 38, 40; 29/13

[56] References Cited

U.S. PATENT DOCUMENTS

| | | | |
|---|---|---|---|
| 341,431 | 4/1886 | Richards | 29/13 |
| 699,290 | 5/1902 | Daniel | 402/13 |
| 1,469,388 | 10/1923 | McBee | 402/17 |
| 2,132,693 | 10/1938 | Martin et al. | 29/13 |
| 2,184,276 | 12/1939 | Brennan | 402/22 |
| 3,026,876 | 3/1962 | Peynado | 129/41 |
| 3,078,853 | 2/1963 | Klein | 402/68 |
| 3,224,450 | 12/1965 | Whittemore et al. | 402/68 |
| 3,970,331 | 7/1976 | Giullie | 402/68 |
| 4,202,642 | 4/1980 | Sjostedt | 402/68 |
| 4,288,170 | 9/1981 | Barber | 402/64 |
| 4,304,499 | 12/1981 | Purcocks | 402/63 |
| 4,305,675 | 12/1981 | Jacinto | 402/68 |
| 4,405,250 | 8/1983 | Wu | 402/13 |
| 4,415,289 | 11/1983 | Barba | 402/17 |
| 4,486,111 | 12/1984 | Hulber | 402/80 P |

FOREIGN PATENT DOCUMENTS

| | | | |
|---|---|---|---|
| 483753 | 4/1977 | Australia | 412/43 |
| 1080727 | 9/1967 | United Kingdom . | |
| 1400460 | 7/1975 | United Kingdom . | |

*Primary Examiner*—E. R. Kazenske
*Assistant Examiner*—Paul M. Heyrana, Sr.
*Attorney, Agent, or Firm*—Julian Caplan

[57] ABSTRACT

A first plastic strip has longitudinally spaced studs each of which can be bent over at a 90° angle. A second strip has holes through which the studs fit and grooves which receive and secure the bent over studs. Several stud shapes and bent stud retaining grooves are described. Paper punched to receive the studs is clamped between the two strips. The studs are then bent over into grooves in the second strip and held in bent position. The paper is thus securely bound. A channel may be slipped over the outside of the second strip to conceal the bent studs and further secure them in place.

9 Claims, 30 Drawing Figures

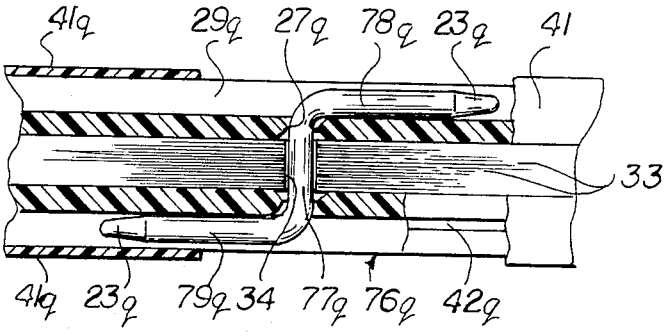
Fig. 22
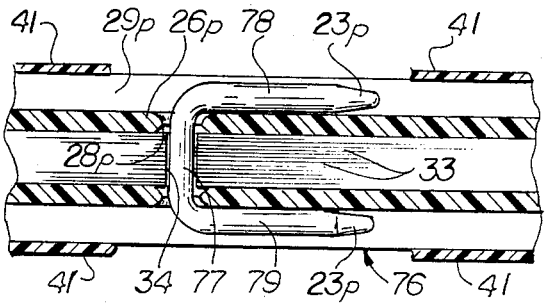
Fig. 21
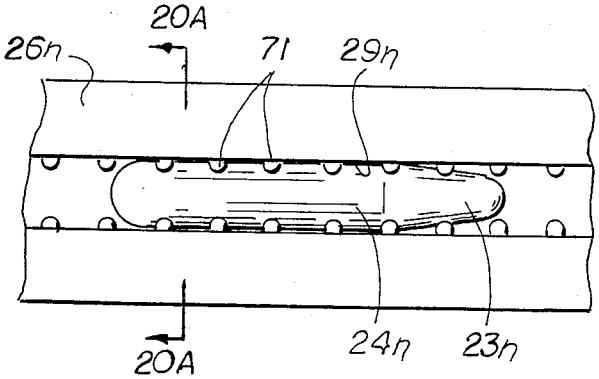
Fig. 20
Fig. 20A
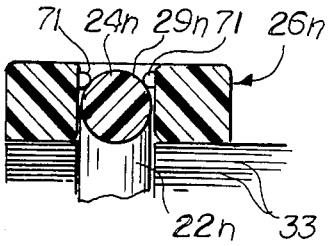

BOOKBINDING STRIPS AND METHOD OF BINDING BOOKS

FIELD OF THE INVENTION

This invention relates to a new and improved bookbinding strip and method of binding books. A popular bookbinding uses a pair of strips, one strip having relatively rigid thermoplastic studs projecting therefrom, the other having holes to receive the studs. Paper formed with holes complementary to the studs is clamped between the pair of strips, the excess stud lengths are cut off and the ends of the studs preferably formed with rivet heads, completing the bind. The present invention uses flexible studs and grooves are formed in the second strip to receive the bent over stud lengths. Thus the excess stud length is not cut off.

DESCRIPTION OF THE PRIOR ART

As has been stated, pairs of plastic strips such as those shown in U. S. Pat. No. 4,369,013 are widely commercially available for use in binding machines. The present invention differs from such strips in two respects: First, the studs are flexible and, second, grooves are formed in the female strip to receive the studs.

Flexible metallic studs have also commonly been used primarily for non-permanent binding of papers into file folders. The commercially available binders of this type sold under the trademark ACCOPRESS, are either used without a second strip or, when used with a second strip, the latter has been of a complicated type having movable slides which hold the bent over binding strips in place.

Long, flexible studs have also been used for binding computer paper and the like, but such binding strips also require complicated means for holding the bent over studs in place.

OBJECTS OF THE INVENTION AND SUMMARY THEREOF

The present invention provides a female strip formed with grooves and latching means of the type hereinafter described in detail, to receive flexible studs of the opposite member. An extremely secure bind is accomplished without the use of complicated machinery or complicated bent stud retaining means.

More particularly, it is an object of this invention to provide a pair of strips, one have longitudinally spaced flexible plastic studs and the other having holes complementary to the spacing of the studs adjacent one or more grooves into which the bent over studs may be inserted and also provided with retaining means of a very simple nature holding the studs in bent over position.

A further object of the invention is to provide a binding means which does not require cutting or heading of the studs. The bind may be accomplished either manually or with apparatus which is relatively simple as compared with that previously used.

Mechanical simplicity of the strips is a further object of the invention. The locking means is built into the strip. No rivetting is required.

Since it is unnecessary to cut off excess scrap length, disposal of scrap is not a problem.

Another object of the invention is that the use of flexible studs permits unsnapping the bent stud ends from the retaining means, removing the female strip, adding or subtracting sheets and then rebinding the book. If a permanent bind is desired, the stud ends or strip may be permanently deformed.

Among the advantages of the invention is the final appearance of the book. The bent over stud ends resemble stitched bindings.

The strength of the bind is highly satisfactory. Failure occurs by breakage of the studs (a function of their cross-section area) rather than by reason of the ends of the studs pulling out of the retaining means.

Other objects of the present invention will become apparent upon reading the following specification and referring to the accompanying drawings in which similar characters of reference represent corresponding parts in each of the several views.

In the drawings:

FIG. 1 a fragmentary perspective view of a book formed in accordance with one modification of the present invention;

Figure 2:
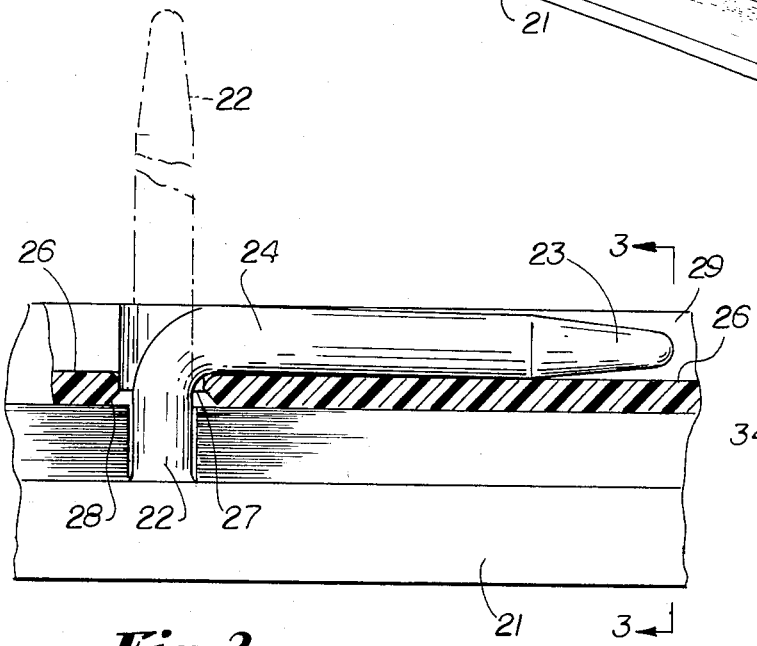
FIG. 2 is an enlarged sectional view take substantially along the line 2—2 of FIG. 1.
Figure 5:
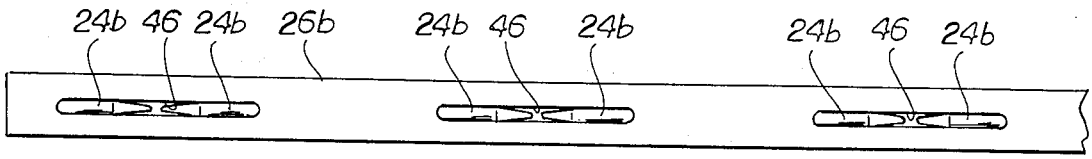
FIGS. 5, 5A and 6 are plan views of the strips of modifications of the present invention.
Figure 18:
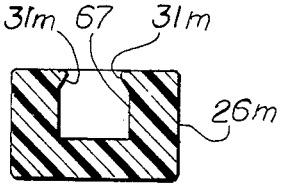
Figure 17:
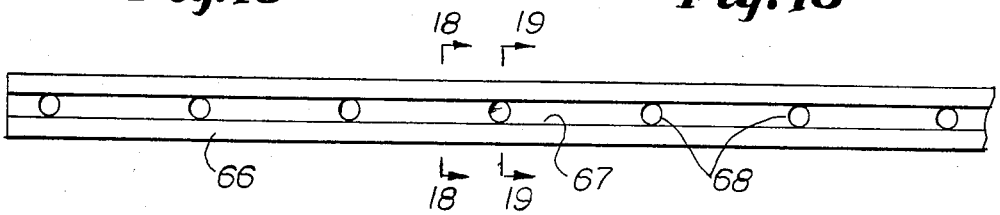
FIG. 17 is a plan view of a modified female strip.
Figure 19:
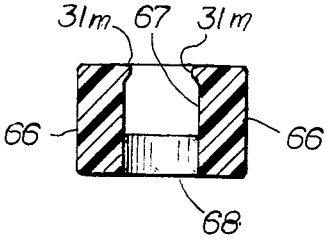

FIGS. 18 and 19 are sectional views taken substantially along the lines 18—18 and 19—19 of FIG. 17;

FIG. 20 a view similar to FIG. 5 of a further modification;

FIG. 20A is a sectional view taken along line 20A—20A of FIG. 20;

FIG. 21 is a view similar to FIG. 2 of a still further modification;

FIG. 22 is a view similar to FIG. 2 of still another modification.

Figure 27:
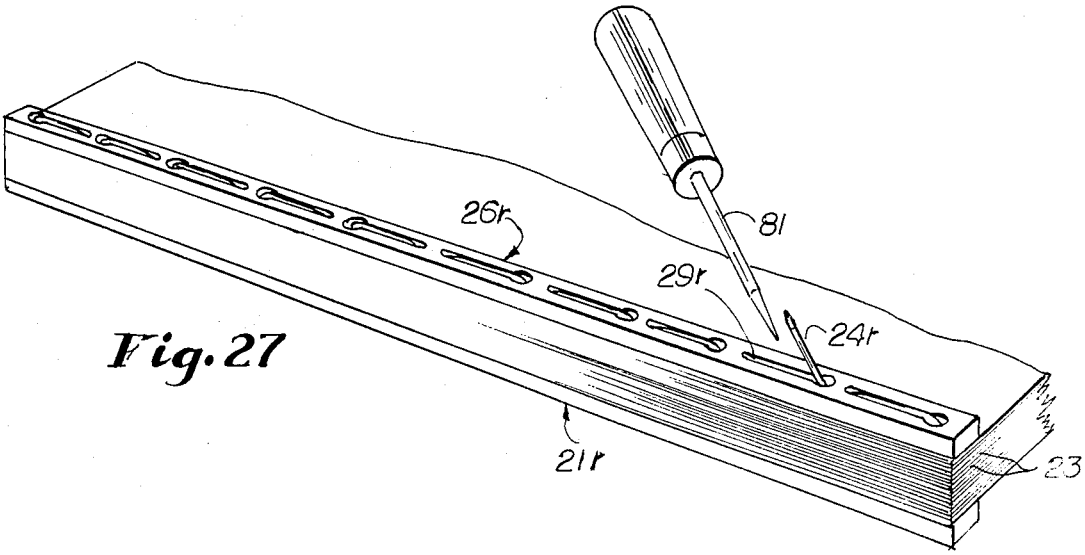
Figure 26:
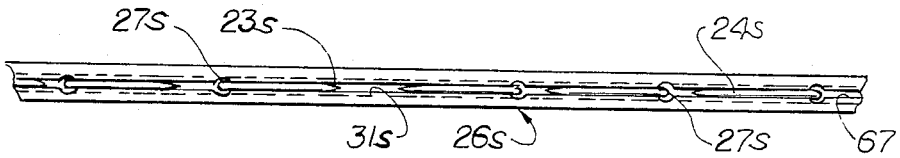
Figure 23:
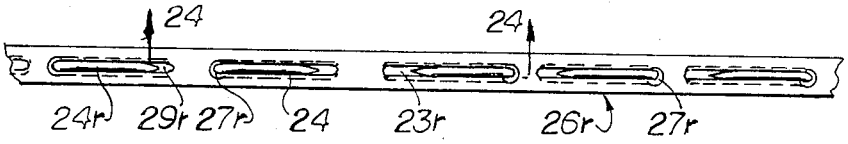
Figure 24:
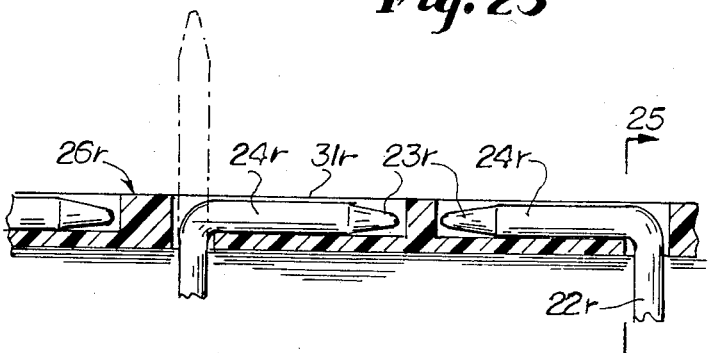
Figure 25:
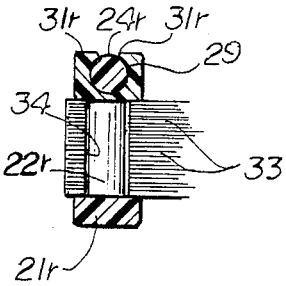

FIG. 23 is a view similar to FIG. 5 of another modification;

FIG. 24 is an enlarged sectional view taken substantially along the line 24—24 of FIG. 23;

FIG. 25 is a cross-section taken substantially along the line 25—25 of FIG. 24;

FIG. 26 is a view similar to FIG. 23 of still another modification;

FIG. 27 is a fragmentary perspective view showing unbending of a stud of the modification of FIG. 23.

DESCRIPTION OF PREFERRED EMBODIMENTS

In the form of the invention shown in FIGS. 1-4, there is provided a male strip 21, preferably of a thin narrow plastic material. Either integral therewith or inserted therein at spaced intervals along the strip 21 are flexible plastic studs 22 having pointed ends 23. The material of the studs 22 may be of polypropylene, polyethelene, K-resin and any of a group of thermoplastic elastomers. The stud length 24 which is in excess of the length necessary to accommodate the pages being bound is bent over. The flexible nature of the plastic material of which the studs 22 is formed makes it possible to bend the studs at a relatively abrupt angle, specifically 90°.

The female strip 26 is likewise preferably of plastic and is formed with spaced holes 27 complementary to the spacing of the studs 22. To facilitate the tips 23 being inserted in holes 27, the bottom surface of strips 26 is preferably formed with a counterbore 28, or countersink. The top surface of strip 26 is formed with one or more longitudinally extending grooves 29 to receive the bent portions 24. In the form of the invention shown in FIGS. 1–4, the grooves 29 are formed with overhangs 31 along each upper edge. Thus the bent over portion 24 snaps between the overhangs 31 and is retained in place thereby.

Figure 4:
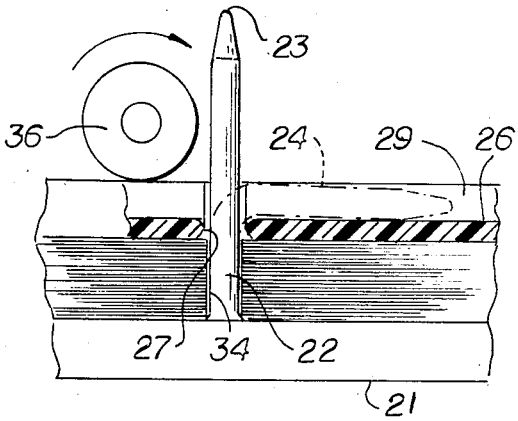
FIG. 4 is more or less schematic view showing one means whereby the studs may be bent over.

The book of the present invention is used to bind a plurality of sheets 33 formed with holes 34 complementary to the spacing of the studs 22. Referring to FIG. 4, the strip 21 is placed with studs 22, projecting upright. Sheets 33 are then assembled on the studs 22. Thereupon the second strip 26 is installed over the studs 22, the counterbores 27 facilitating entry of the pointed ends 23. Thereupon the studs 23 are bent over at a right angle into the grooves 29. As shown schematically in FIG. 4, a roller 36 may cause the studs to be bent. The excess stud lengths 24 snap between the overhangs 31.

Directing attention to FIG. 1, it will be seen that the right end-most bent over portion 24 is directed in the groove 29 in an opposite direction from the other bent over portions; however, other arrangements, some of which are hereinafter set forth in detail may be employed.

Figure 1:
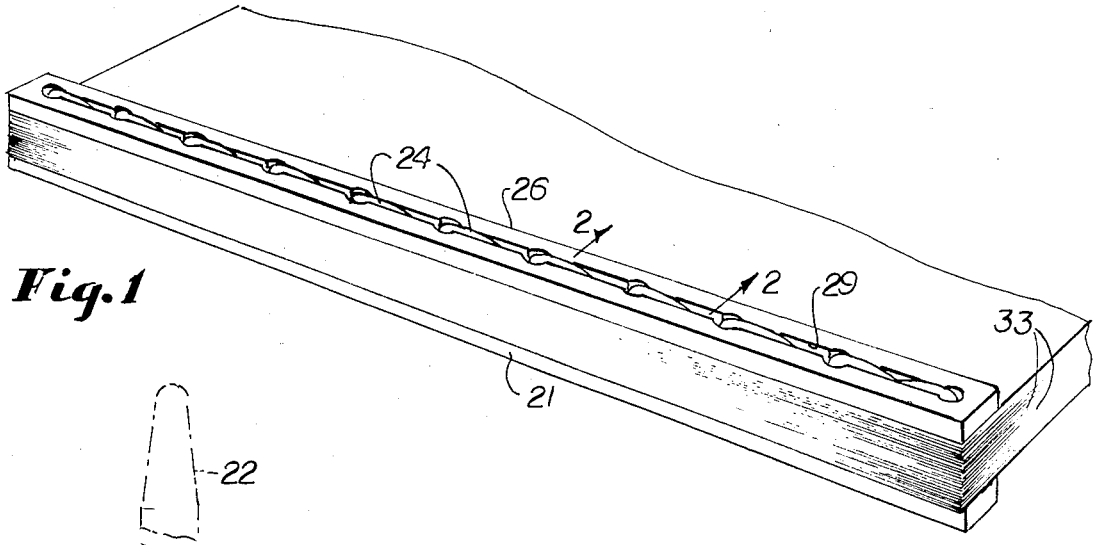
Figure 3:
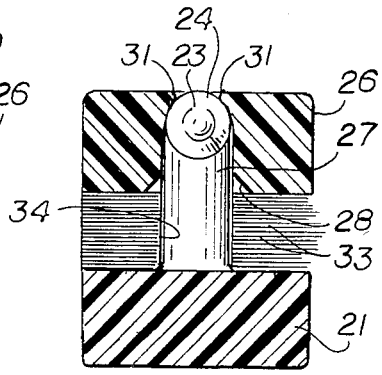
FIG. 3 is a sectional view taken substantially along the line 3—3 of FIG. 2.
Figure 3A:
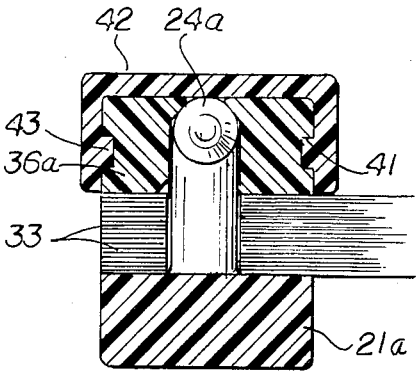
FIG. 3A is a view similar to FIG. 3 of a modification.

In order to conceal the top of the strip 26 shown in FIG. 1, the alternate of FIG. 3A may be used. In this form of the invention, longitudinal grooves 41 may be formed in the side edges of the strip 26*a*. A channel 42 having inward extending projections 43 fit into the grooves 41. The channel 42 may be snapped into place or slid lengthwise from one end of the strip 26.

Figure 5A:
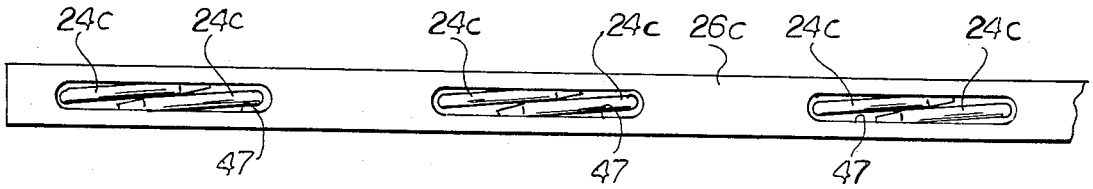

FIG. 5 shows pairs of bent over portions 24*b* turned toward each other inserted in grooves 46 rather than being in the same direction as shown in FIG. 1. FIG. 5A shows the bent over portions 24*c* overlapping, the grooves 47 being of extended width and of a length approximately equal to the grooves 46 of FIG. 5.

Figure 6:
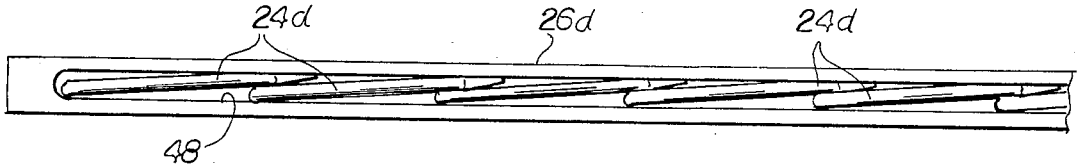

FIG. 6 shows a groove 47 of considerable width to accommodate the bent over portions 24*d* pointing in the same direction but overlapping adjacent bent over portions 24*d*.

Figure 7:
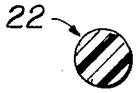
FIG. 7 is a cross-sectional view through the stud of FIG. 1.
Figure 8:
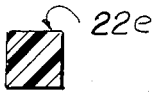
FIG. 8 is a view similar to FIG. 7 of a modification.

FIG. 7 shows a circular cross-section stud 22. In FIG. 8 it is shown that the stud 22*e* could be square in cross-section or other convenient shape.

Figure 10:
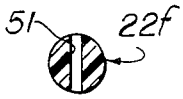
FIG. 10 is a sectional view taken substantially along the line 10—10 of FIG. 9.
Figure 9:
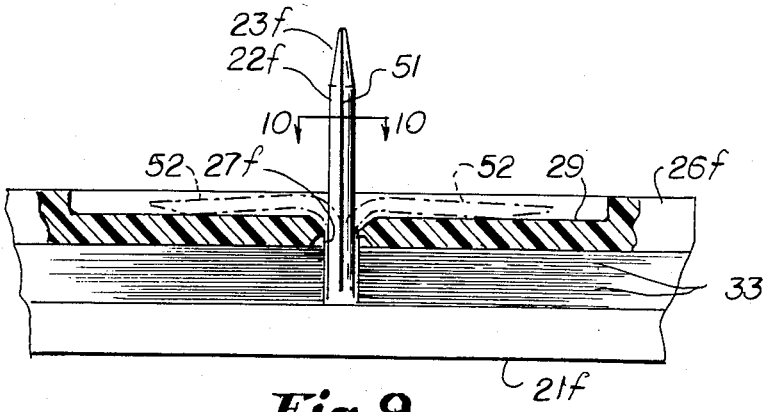
FIG. 9 is a view similar to FIG. 2 of a further modification.

Directing attention to FIGS. 9 and 10, studs 22*f* may be formed with a longitudinal split 51, extending from the tip 23*f* to approximately the point where the stud 22*f* joins the strip 21*f*. The halves of the stud 22*f* may be bent in opposite directions so that the bent halves 52 seat in the grooves 29. Thus, the stud 22*f* functions similarly to a cotter pin.

Figure 11:
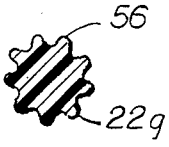
FIG. 11 is a view similar to FIG. 7 of a further modification.
Figure 12:
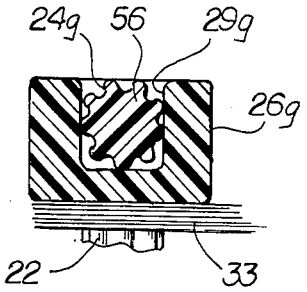
FIG. 12 is a view similar to the modification of FIG. 3, showing use of a stud in accordance with FIG. 11.

As an alternate to the round cross-section configuration of FIG. 7, FIG. 11 shows stud 22*g* with a fluted configuration 56. As shown in FIG. 12, the flutes 56 dig into the sides of the channel 29*g* in female strip 26*g*, making the overhangs of the modification of FIG. 3 unnecessary. The flutes 56 stud 22*g* is pushed into the groove 29*g*, thereby holding the bent over portion 24*g* in place by friction.

Figure 13:
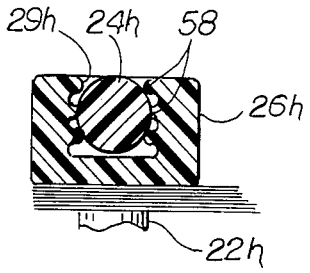
FIGS. 13, 14, 15 and 16 are views similar to FIG. 12 of further modifications.
Figure 14:
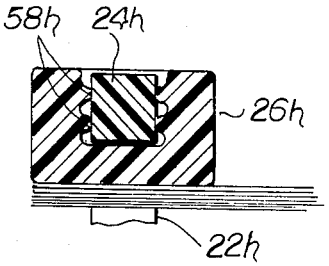

FIG. 13 shows a female strip 26*h* wherein flutes 58 are formed in the groove 29*h*. The bent over portion 24*h* of the stud 22*h* may be round in cross-section. In FIG. 14, the stud 22*h* is shown square in cross-section. It will be understood that other cross-sectional shapes of studs may be used.

Figure 15:
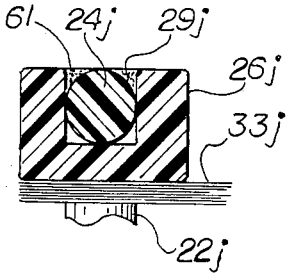
Figure 16:
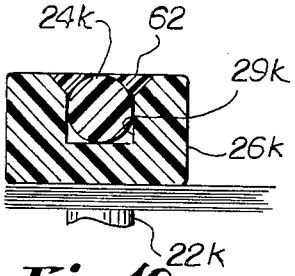

In FIG. 15, the overhangs 31 of the modification of FIG. 3 have been eliminated. Adhesive 61 may be used to retain the bent over portion 24*j* in place in groove 29*j*. FIG. 16 shows a weld or brazing 62 holding the bent over portion 24*k* in the channel 29*k*.

The grooves 29 of the previous modification are either intermittent or continuous. FIG. 17 shows a modification wherein the strips 66 are extruded, there being a continuous channel or extended groove 67 formed therein. At spaced intervals, holes 68 to accommodate the studs (not shown) are formed by punching or other means.

FIG. 20 shows a modification wherein one or both of the opposed sides of the groove 29*n* is formed with flexible inward extending tips 71. The bent over portion 24*n* stud 22*n* snaps under the tips 71 and is held in place.

FIG. 21 shows a female strip 26*p* similar to strip 26 of FIG. 2. Instead of a male strip, a second female strip 76 is provided substantially identical to strip 26*p* A length of stud material 27 havin9 two pointed ends 23*p* is inserted through one of the strips 26*p*, 76, through the holes 34 in the sheets 33 and through the hole 27*p* in the other strip 26*p*, 76. The strips are compressed together and then the ends 78 and 79 of the stud material 77 are bent over into the grooves 29*p* of both strips. The bent over portions 78, are retained in place by any of the means shown in the preceding modifications. A channel 42*p* having projections 43*p* fitting into grooves 43*p* in the side edges of each strip 26*p*, 76 may conceal grooves 29*p* and bent portions 78, 79 as in FIG. 3A.

As shown in FIG. 21, the stud material 77 is bent in U-shape. As shown in FIG. 22, the stud material 77*q*, is bent in a general Z-shape, so that the end 78*q* and 79*q* are disposed in opposite directions.

In the form of the invention shown in FIGS. 23–25 there is no stud 22 in the middle of the first strip 21*r* nor is there a hole 27 in the second strip 26*r*. Each stud 22*r* at the left hand side of the book as viewed in FIG. 23 is bent toward the middle, and each stud 22*r* on the right hand side is bent toward the middle. Such bending may be accomplished manually or by an appropriate tool.

Directing attention to the cross-section shown in FIG. 25 it will be seen that each groove 29*r* in strip 26*r* is formed substantially complementary to the shape of a stud 22*r*. On either outer longitudinal edge of the groove 29*r* is an overhang 31*r* (which may be approximately 3 mil. in width). When the stud end 24*r* is bent, the overhangs 31*r* spring apart sufficiently to permit the stud end 24*r* to enter the groove 29*r* and the overhangs 31*r* retain the same in place.

In FIG. 23 there are individual grooves 29*r* for each hole 27*r*. In FIG. 26 there is a single groove 67*s* extending longitudinally of strip 26*s*.

It may be desirable, from time to time, to add or subtract sheets 33 from the stack of sheets bound. As shown in FIG. 27 by appropriate tool 81, the ends 24*r*, 24*s* of the studs may be bent back to upright position. Thereupon the strips 26*r*, 26*s* may be removed and appropriate punched sheets 33 removed from or added to, or rearranged in position in the stack of sheets. Thereafter, the strips 26*r*, 26*s* may be replaced and the studs 22*r*, 22*s* bent to snap into the grooves 29*r*, 29*s*.

The modifications of FIGS. 3A, 5, 5A, 6, 8, 9, 11, 13, 14, 15, 16, 17, 20, 21, 22, 23 and 26 in many particulars resemble the structure of preceding modifications and the same reference numerals followed by subscripts a, b, c, d, e, f, g, h, j, k, m, n, p, q, r and s, respectively, are used to represent corresponding elements.

What is claimed is:

1. A book comprising a core comprising a plurality of sheets, each sheet being formed with at least four first holes spaced apart longitudinally and inwardly of the spine edge of said sheet;

a first strip overlying the spine edge of said core on one side of said book having a plurality of integral round, smooth, flexible plastic studs integral with said first strip and bendable at approximately a 90° angle spaced the same intervals as said first holes extending outward of said first strip;

a second strip overlying the spine of said core on the side of said book opposite said first strip formed with a plurality of second holes spaced the same intervals as said first holes, and for each said second hole a separate, smooth-walled groove in the outer surface of said second strip communicating with and extending away from said second hole and being of a length slightly longer than the length of said studs, each said groove having stud retaining means comprising at least one smooth-surfaced overhanging lip extending longitudinally substantially the entire length of said groove adjacent only the outside of said groove;

each said stud extending outward from said first strip through said first holes in said core and one said second hole and being bent at approximately a 90° angle and snapped down into one said groove and under said overhanging lip so that said stud is held in place in said groove.

2. A book according to claim 1 wherein all of said studs on a first side of the middle of said first strip are bent inwardly toward the middle of said second strip and all of said studs on the second side of the middle of said first strip are bent inwardly toward the middle of said second strip.

3. A book according to claim 2 in which there is no stud at the middle of said strips.

4. Strips according to claim 2 in which there is a separate groove communicating with each said hole in said second strip, all of said separate grooves on a first side of the middle of said second strip extending inward toward said middle from the holes with which they communicate and all of said separate grooves on a second side of said middle extending toward said middle from the holes with which they communicate.

5. Bookbinding strips for use with a core formed of a plurality of sheets, each sheet having at least four first holes spaced apart longitudinally and inwardly of the spine edges of said sheets;

comprising a first strip overlying the spine edge of said core on one side of said book having a plurality of integral round, smooth, flexible plastic studs integral with said first strip and bendable at approximately a 90° angle spaced the same intervals as said first holes extending outward of said first strip;

a second strip overlying the spine of said core on the side of said book opposite said first strip formed with a plurality of second holes spaced the same intervals as said first holes, and for each said second hole a separate, smooth-walled groove in the outer surface of said second strip communicating with and extending away from said second hole and being of a length lightly longer than the length of said studs, each said groove having stud retaining means comprising at least one smooth-surfaced overhanging lip extending longitudinally substantially the entire length of said groove adjacent only the outside of said groove;

whereby each said stud may be inserted extending outward of said first strip through said first holes in said core and one said second hole and bent at approximately a 90° angle and snapped down into one said groove and under said overhanging lip so that said stud is held in place in said groove.

6. A method of binding a book comprising providing a plurality of sheets, each sheet having at least four first holes spaced apart longitudinally and inwardly of the spine edges of said sheets; a first strip overlying the spine edge of said core on one side of said book having a plurality of round, integral smooth, flexible plastic studs integral with said first strip and bendable at approximately a 90° angle spaced the same intervals as said first holes extending outward of said first strip; and a second strip overlying the spine of said core on the side of said book opposite said first strip formed with a plurality of second holes spaced the same intervals as said first holes, and for each said second hole a separate, smooth-walled groove in the outer surface of said second strip communicating with and extending away from said second hole and being of a length slightly longer than the length of said studs, each said groove having stud retaining means comprising at least one smooth-surfaced overhanging lip extending longitudinally substantially the entire length of said groove adjacent only the outside of said groove;

assembling said sheets in a core with said first holes aligned;

inserting each said stud through aligned first holes in said core and one said second hole;

bending each said stud at approximately a 90° angle and snapping each said stud down into one said groove and under said overhanging lip so that said stud is held in place in said groove.

7. A method according to claim 6 wherein said step of bending the ends of said studs comprises bending all of said studs on a first side of the middle of said second strip inward toward said middle and then bending all of said studs on said second side inward toward said middle.

8. A method according to claim 6 which further comprises unbending said studs to substantially upright position, removing said second strip from contact with said studs, adding or removing sheets from said stack, replacing said second strip and rebending the ends of said studs into said groove.

9. A method according to claim 8 which further comprises retaining the rebent ends of said studs in said groove.

* * * * *